United States Patent [19]

Temme

[11] Patent Number: 4,733,770

[45] Date of Patent: Mar. 29, 1988

[54] TRANSFER STATION

[75] Inventor: Ulrich Temme, Waltrop, Fed. Rep. of Germany

[73] Assignee: Gewerkschaft Eisenhutte Westfalia GmbH, Lunen, Fed. Rep. of Germany

[21] Appl. No.: 69,123

[22] Filed: Jul. 2, 1987

[30] Foreign Application Priority Data

Jul. 11, 1986 [DE] Fed. Rep. of Germany ..... 3623411

[51] Int. Cl.[4] ..... B65G 47/76

[52] U.S. Cl. ..... 198/599; 198/606; 209/658; 299/43

[58] Field of Search ..... 198/599, 637, 606, 607, 198/560; 299/43, 64; 209/658

[56] References Cited

U.S. PATENT DOCUMENTS

| | | | |
|---|---|---|---|
| 3,524,531 | 8/1970 | Georg | 198/637 X |
| 4,586,753 | 5/1986 | Braun et al. | 198/607 X |
| 4,673,079 | 6/1987 | Gründken et al. | 198/599 |

FOREIGN PATENT DOCUMENTS

| | | | |
|---|---|---|---|
| 2600999 | 7/1977 | Fed. Rep. of Germany | 198/606 |
| 2149395 | 12/1979 | Fed. Rep. of Germany | 198/606 |
| 3306568 | 8/1984 | Fed. Rep. of Germany . | |
| 3544274 | 8/1986 | Fed. Rep. of Germany | 198/637 |
| 1463764 | 2/1977 | United Kingdom | 198/606 |

*Primary Examiner*—Robert J. Spar
*Assistant Examiner*—Cheryl L. Gastineau
*Attorney, Agent, or Firm*—Sughrue, Mion, Zinn, Macpeak and Seas

[57] ABSTRACT

A transfer station is disclosed for transferring mineral material from a longwall conveyor to a loading conveyor. The loading conveyor has two straight portions joined by a curved portion, one of the straight portions extending in the longitudinal direction of the longwall conveyor, and being positioned beneath the end of the longwall conveyor. The longwall conveyor extends over the loading conveyor in the region of its curved portion. Larger pieces of mineral material are deflected, by a lateral deflector in the exit region of the curved portion of the loading conveyor, from the longwall conveyor, while the finer conveyed material is delivered at the end of the longwall conveyor onto the loading conveyor.

8 Claims, 4 Drawing Figures

TRANSFER STATION

BACKGROUND OF THE INVENTION

This invention relates to a transfer station for transferring mineral material from a longwall conveyor to a roadway loading conveyor in a mine working.

In a known transfer station of this kind (see DE-OS No. 3 306 568), which is intended for the diversion of conveyed mineral material from a longwall working into a roadway, the discharge end of the longwall conveyor and the reversing end of the loading conveyor are combined in a common drive frame, the discharge end of the longwall conveyor lying above that part of the drive frame accomodating the reversing drum of the loading conveyor. Since the loading conveyor, which feeds the conveyed mineral material to a roadway conveyor, has a considerably smaller length than the longwall conveyor, it requires no heavy and expensive roller curve to deflect the mineral material through the 90° curved path between the two conveyors. Thus, compared with a longwall conveyor provided with a roller curve, this known transfer station has a reduced constructional expense. Moreover, it enables a double centre-chain scraper assembly to be used for the longwall conveyor, and this is advantageous for long longwall workings.

The known transfer station is admittedly not free from disadvantages. By way of example, the disadvantages include the relatively large overall dimensions, and especially the great overall height of the transfer station which results from the fact that the drive frame of the longwall conveyor and the reversing frame of the loading conveyor are fitted one above the other. Moreover, the loading conveyor is constructed relatively far in advance of the discharge end of the longwall conveyor. Therefore, it is not possible to advance the drive frame of the longwall conveyor into the roadway, and in doing so to prolong a winning machine guide on the longwall conveyor sufficiently far into the roadway to enable the longwall winning machine to cut the roadway profile or to win the seam in the roadway region. The overhead delivery at the discharge end of the longwall conveyor is also disadvantageous with regard to the transference of large pieces of material, since the conveying cross-section of the longwall conveyor is somewhat constricted in the region of its drive frame, and conveying troubles can arise in the passage of large pieces along the curved region of the loading conveyor. Finally, in the known transfer station, it is impossible, in the case of plough winning in a longwall working to provide a stepped-up plough drive adjacent to the free end of the drive frame of the longwall conveyor.

The object of the invention is to provide a transfer station which will satisfactorily transfer conveyed material whilst having smaller overall dimensions. Another object is to provide a transfer station that enables a winning machine guide to be extended from a longwall working into an adjacent roadway, so that cutting of the roadway profile or seam working within the roadway profile is possible with the aid of the winning machine provided in the longwall working.

SUMMARY OF THE INVENTION

The present invention provides a transfer station for transfering mineral material from a longwall conveyor to a roadway loading conveyor, the longwall conveyor having a conveyor chain drive drum mounted in a drive frame which extends over the loading conveyor, the loading conveyor having two straight portions joined by a curved portion, wherein one straight portion of the loading conveyor extends in the direction of the longwall conveyor and transports mineral material in the opposite direction to that in which the longwall conveyor transports mineral material, the longwall conveyor extending over the loading conveyor in the region of its curved portion, the free end of said one straight portion of the loading conveyor being positioned beyond the drive frame of the longwall conveyor, and wherein means are provided for laterally delivering large pieces of mineral material from the longwall conveyor to the loading conveyor, said means extending over the conveying run of the longwall conveyor in the region of overlap with the loading conveyor.

In this case, the loading conveyor may be provided with an approximately 90° curved portion, and the loading conveyor can be set back, in relation to the drive frame arranged at the discharge end of the longwall conveyor, towards the longwall. Moreover, only the end region of the loading conveyor, forming a reversing drive frame is positioned beyond the drive frame of the longwall conveyor. In this way, the entire transfer station can be of smaller overall dimensions than known transfer stations.

Preferably, the drive frame of the longwall conveyor is supported on said one straight portion of the loading conveyor. In this way the height of the transfer station is reduced, as the drive frame of the longwall conveyor is supported on a channel section of said one straight portion of the loading conveyor rather than on the drive frame of the loading conveyor. Since the reversing drum of the loading conveyor lies on the roadway side beyond the drive frame of the longwall conveyor, sufficient installation space is available for a chain drum drive of conventional type driving the reversing drum of the loading conveyor.

In a preferred embodiment, an oblique deflector comprises the means for delivering large pieces of mineral material from the longwall conveyor to the loading conveyor, the oblique deflector being arranged on the longwall conveyor above the curved portion of the loading conveyor. In this way, the disadvantages of the overhead delivery of the longwall conveyor in known tranfer stations are also avoided, since large pieces of mineral material are deflected laterally before they reach the drive drum of the longwall conveyor, consequently, these large pieces of mineral material do not have to be conveyed along the entire curved portion. Pieces of mineral material which are too small for deflection in this way are ejected at the delivery end of the longwall conveyor on to the loading conveyor. Any firm material entrained in the lower run of the longwall conveyor likewise arrives at the loading conveyor. In this way, a secure transfer of loose material is achieved with avoidance of conveying troubles due to over-large pieces of mineral material and soiling of the lower run of the longwall conveyor by fine material carried by the scraper-chain assembly.

Advantageously, a winning machine guide is arranged on the longwall conveyor, and extends at least approximately into the delivery end zone of the drive frame of the longwall conveyor. In this way, the roadway profile can be cut, or coal present in the roadway profile can be won, with the aid of the longwall winning machine. The use of a stable hole winning machine in addition to the winning machine working in the longwall is also possible. The configuration of the transfer station in accordance with the invention also permits the use of a stepped-up plough drive station which, in this case, is attached to the drive frame of the loading conveyor.

It is advisable to mount the drive frame of the longwall conveyor and the drive frame of the loading conveyor on a common sub-structure, for example a floor bracket or base plate, both frames being united into one construction unit and being fixed in position in relation to one another.

BRIEF DESCRIPTION OF THE DRAWINGS

A transfer station constructed in accordance with the invention will now be described, by way of example, with reference to the accompanying drawings, in which.

DESCRIPTION OF PREFERRED EMBODIMENT

Figure 1:
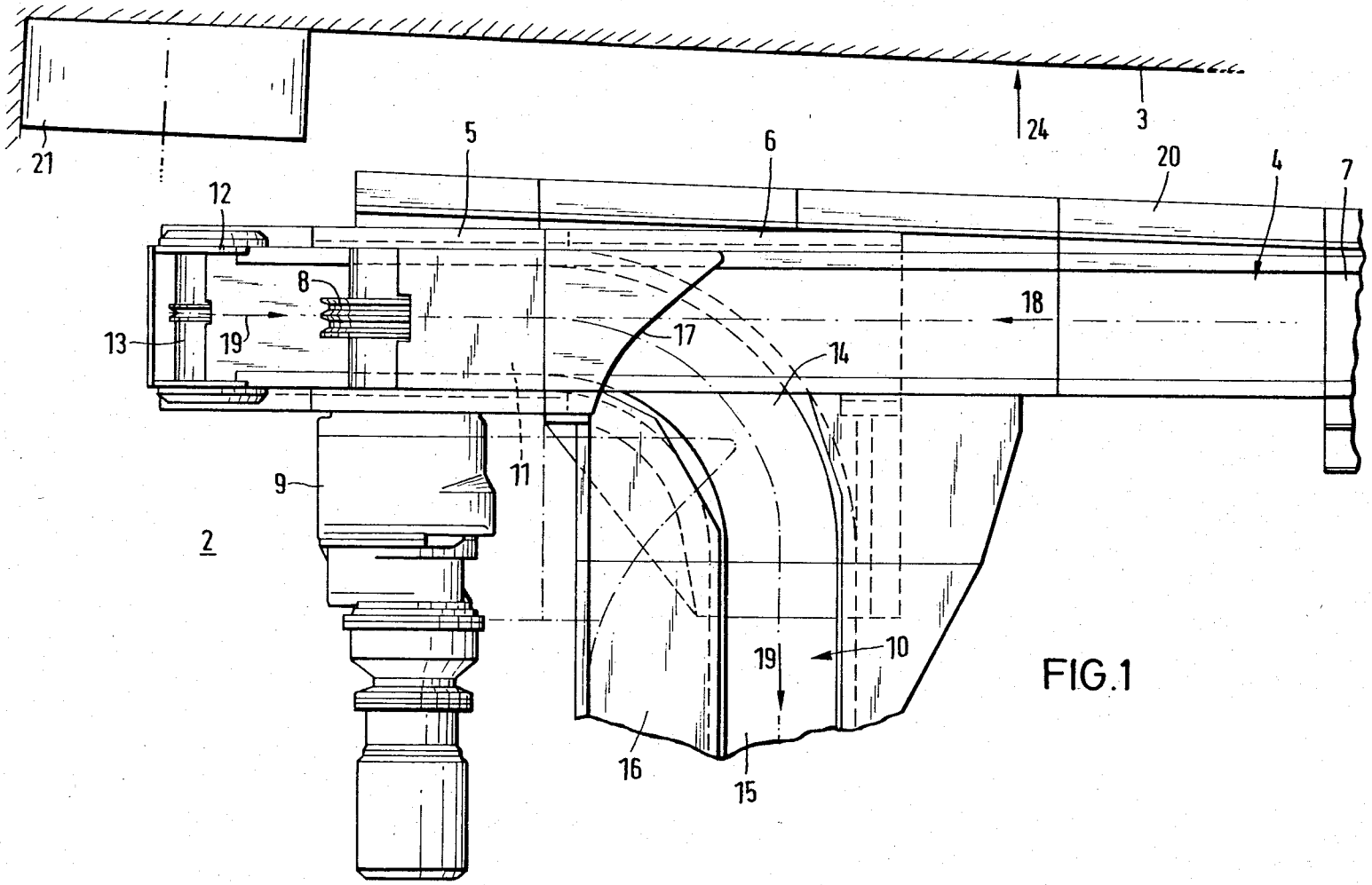
FIG. 1 is a plan view of the transfer station.

Referring to the drawings, FIG. 1 shows a longwall working 1 and an adjacent roadway 2, the roadway having its floor level with the floor in the longwall working. A longwall conveyor 4 extends along the longwall working, in front of a working face 3. In known manner, the longwall conveyor 4 consists of a scraper-chain conveyor, preferably a double centre-chain conveyor in the case of a longwall of great length. The delivery end of the longwall conveyor 4, including its main drive station 9, is positioned in the roadway 2. It comprises a stout drive frame 5 which is connected by a rising intermediate channel section 6, to the line 7 of channel sections (pans) of the longwall conveyor 4. A drive drum 8 is mounted in the drive frame 5, the drive drum serving to drive and deflect the endless scraper chain(s) of the longwall conveyor 4. The conveyor drive station 9 drives the chain drum 8, and is flanged on the goaf-side side plate of the drive frame 5.

Figure 2:
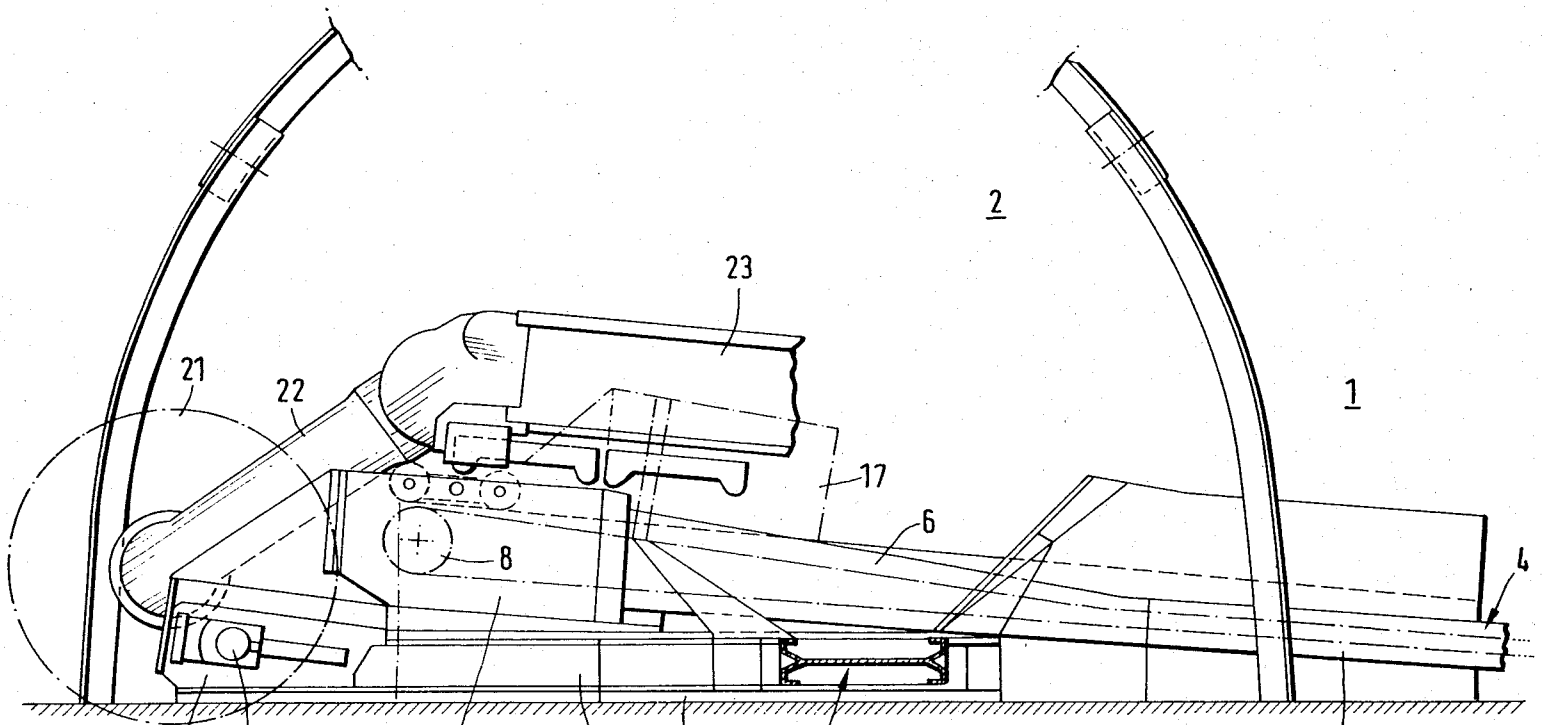
FIG. 2 is a view of the transfer station of Figure 1 looking in the direction towards the working face of a roadway receiving the transfer station.

A loading conveyor 10 is postioned in the roadway 2, the loading conveyor having a curved portion which curves through approximately 90°. The loading conveyor 10 is likewise a scraper-chain conveyor, preferably a centre-chain conveyor with a single chain. One branch 11 of the loading conveyor 10 is aligned with the axis of the longwall conveyor 4. This branch 11 is positioned beneath the delivery end of the longwall conveyor 4, but the drive frame 12 arranged at the reversing end of the loading conveyor 10 is postioned further into the roadway 2 than the drive frame 5 of the longwall conveyor 4. As shown in FIG. 2, the end of the drive frame 12 lies in the vicinity of the wall of the roadway 2 remote from the longwall working 1. A reversing drum 13 of the loading conveyor 10 is mounted in the drive frame 12.

The branch 11 of the loading conveyor 10 lying beneath the longwall conveyor 4 merges on the longwall side, by way of an approximately 90° curved portion 14, into a conveyor branch 15 extending approximately at right-angles to the longwall conveyor 4. The drive drum (not shown) of the loading conveyor 10 is situated at the end of the conveyor branch 15. The reversing drum 13 can also be driven, which can be effected with the aid of a drive station of the usual kind attached laterally to the drive frame 12.

As shown best in FIG. 1, the longwall conveyor 4 extends over the loading conveyor 10, not only in the region of its conveying branch 11, but also in the region of the curved portion 14. As shown in FIG. 2, the longwall conveyor 4 rises towards the roadway 2, and its drive frame 5 lies in the roadway 2. The drive frame 5 is supported on a channel section of the branch 11 of the loading conveyor 10. Since this channel section has lower overall height than the reversing frame 12, a lower overall height results for the construction unit formed by the loading conveyor 10 and the drive frame 5.

The drive frame 5 of the longwall conveyor 4 and the loading conveyor 10 with its drive frame 12, its branch 11 and its curved portion 14 are mounted on a common sub-structure 16 which is constituted by, for example, a floor bracket or a base plate. The two conveyors 4 and 10 are, therefore, united in the transfer region to form an integrally-shiftable transfer station, and are fixed in positon in relation to one another.

In the region of overlap with the curved portion 14 of the loading conveyor 10, the longwall conveyor 4 possesses a lateral delivery in the form of an oblique deflector 17 of known type extending over the conveying run of the longwall conveyor. The longwall conveyor 4 delivers the won mineral material in the direction of the arrow 18, while the loading conveyor 10 delivers in the direction of the arrow 19. Large pieces of mineral material are delivered sideways into the exit region of the curved portion 14 of the loading conveyor 10 by the oblique deflector 17. Smaller pieces of mineral pass beneath the oblique deflector 17, and are discharged over the drive drum 8 onto the branch 11 of the loading conveyor 10. Here, they are firstly conveying beneath the longwall conveyor 4 in the direction of the arrow 19, and then along the curved portion 14 to the delivery end of the loading conveyor. This provides a trouble-free delivery of loose material from the longwall conveyor 4 onto the loading conveyor 10. Moreover, since the curved portion 14 of the loading conveyor 10 lies under the delivery end of the longwall conveyor 4, the transfer station can be used even in relatively narrow roadways.

As shown in FIG. 1, a winning machine guide 20 is attached to the working face side of the longwall conveyor 4, on which guide a longwall winning machine, for example a chain-drawn coal plough or shearer drum, can be guided. FIG. 1 shows that the winning machine guide 20 extends into the roadway 2, approximately as far as the end of the drive frame 5, so that the longwall winning machine can also work in the roadway region. In FIG. 1 a shearer drum is shown at 21, which shearer can cut the roadway profile or the seam over the whole width of the roadway 2. FIG. 2 shows the same shearer drum 21 on a vertically-pivotable shearer arm 22 of a shearing machine which runs with its machine body 23 on the longwall conveyor, possibly with support and guidance on the guide 20 on the working face side. It can be seen from FIG. 2 that the entire roadway profile can be cut with the aid of this shearer.

Figure 3:
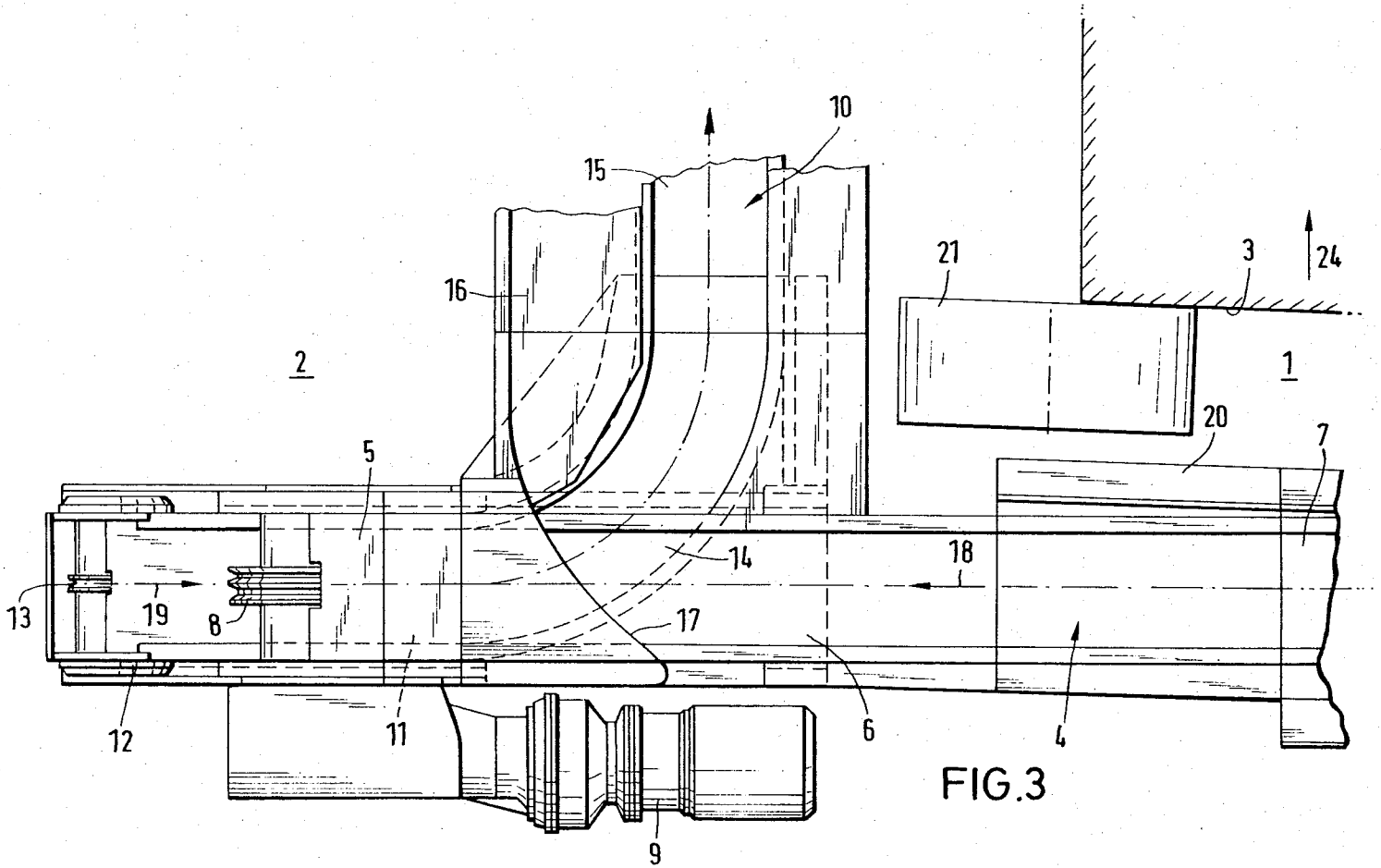
FIG. 3 is a plan view of the transfer station positioned for a reverse working operation.

FIG. 3 shows the transfer station in use in a reverse-working operation, that is where the loading conveyor 10 delivers the won mineral material delivered to it by the longwall conveyor 4, in the direction 24 of face advance. The conveyor drive station 9 is here attached on the goaf side of the drive frame 5, and lies parallel to the longwall conveyor 4. Otherwise, this transfer station corresponds to that shown in FIGS. 1 and 2.

Figure 4:
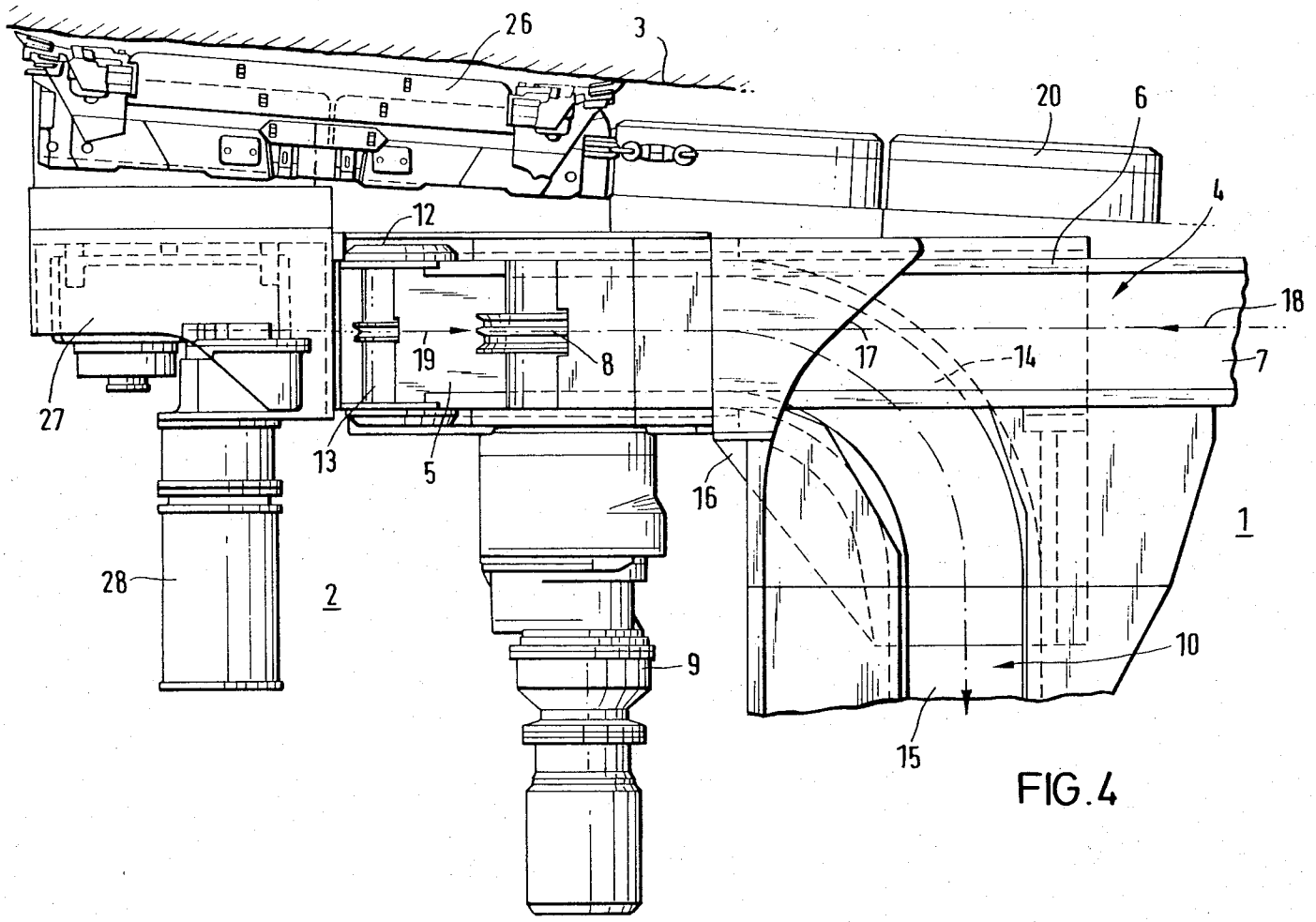
FIG. 4 is a plan view, similar to FIG. 1, of a modified form of transfer station

FIG. 4 shows the transfer station of FIGS. 1 and 2 in combination with a plough winning installation. This installation includes a coal plough 26 which wins the working face 25 by skimming, and is guided on the plough guide 20 arranged on the working face side of the longwall conveyor 4. The guide 20 extends out beyond the drive frame 5 of the longwall conveyor 4 into the vicinity of the roadway wall remote from the longwall. A so-called stepped-up plough drive 27, having a drive motor 28 for the drive of the plough traction chain, is attached to the free end of the drive frame 12 of the loading conveyor 10. Therefore, with this arrangement, the plough 26 can win the seam over the whole width of the roadway 2.

The transfer station described above has a loading conveyor 10 which, because of its considerably shorter length in comparison with the longwall conveyor 4, does not need a roller curve for the deflection of the scraper-chain assembly in the curved region. Rather, it is possible to work with a simple sliding bend, in which the scrapers attached centrally to an endless scraper-chain travel round the curved portion 14 with the inside ends of their scrapers sliding in the scraper guide of the conveying channel.

I claim:

1. A transfer station for transferring mineral material from a longwall conveyor to a roadway loading conveyor, the longwall conveyor having a conveyor chain drive drum mounted in a drive frame which extends over the loading conveyor, the loading conveyor having two straight portions joined by a curved portion, wherein one straight portion of the loading conveyor extends in the direction of the longwall conveyor and transports mineral material in the opposite direction to that in which the longwall conveyor transports mineral material, the longwall conveyor extending over the loading conveyor in the region of its curved portion, the free end of said one straight portion of the loading conveyor being positioned beyond the drive frame of the longwall conveyor, and wherein means are provided for laterally delivering large pieces of mineral material from the longwall conveyor to the loading conveyor, said means extending over the conveying run of the longwall conveyor in the region of overlap with the loading conveyor.

2. A transfer station according to claim 1, wherein the drive frame of the longwall conveyor is supported on said one straight portion of the loading conveyor.

3. A transfer station according to claim 1 or claim 2, wherein the drive frame of the longwall conveyor is mounted on a common sub-structure together with a drive frame provided at the free end of said one straight portion of the loading conveyor.

4. A transfer station according to claim 3, wherein the sub-structure is a base plate.

5. A transfer station according to claim 3, wherein a winning machine guide is arranged on the longwall conveyor, and extends at least approximately into the delivery end zone of the drive frame of the longwall conveyor.

6. A transfer station according to claim 5, wherein the winning machine guide is arranged on the working face side of the longwall conveyor.

7. A transfer station according to claim 6, wherein a plough drive station is mounted adjacent to the drive frame of the loading conveyor, the plough drive station being adapted to drive a chain-drawn plough arranged on the guide, the guide extending past the drive frame of the longwall conveyor and past the drive frame of the loading conveyor into the region of the plough drive station.

8. A transfer station according to claim 1, wherein an oblique deflector comprises the means for delivering large pieces of mineral material from the longwall conveyor to the loading conveyor, the oblique deflector being arranged on the longwall conveyor above the curved portion of the loading conveyor.

* * * * *